US005270076A

United States Patent [19]

Evers

[11] Patent Number: 5,270,076

[45] Date of Patent: Dec. 14, 1993

[54] PROCESS FOR COATING ALKYL KETENE DIMER ON TITANIUM DIOXIDE

[75] Inventor: Glenn R. Evers, Wilmington, Del.

[73] Assignee: E. I. Du Pont de Nemours and Company, Wilmington, Del.

[21] Appl. No.: 684,133

[22] Filed: Apr. 11, 1991

[51] Int. Cl.[5] ..... B05D 7/24

[52] U.S. Cl. ..... 427/220; 106/447; 162/158; 162/181.4; 162/181.5; 427/242; 241/21

[58] Field of Search ..... 427/220, 221, 242; 162/135, 158, 181.4, 181.5; 106/447, 504; 241/21

[56] References Cited

U.S. PATENT DOCUMENTS

| | | | |
|---|---|---|---|
| 2,215,857 | 9/1940 | Plechner et al. | 106/447 |
| 2,291,082 | 7/1942 | Jarmus et al. | 106/447 |
| 2,785,067 | 3/1957 | Osberg, Jr. | 162/158 |
| 2,865,743 | 12/1958 | Weisgerber | 162/158 |
| 2,952,580 | 9/1960 | Frasch | 162/158 |
| 2,992,964 | 7/1961 | Werner et al. | 162/158 |
| 3,436,239 | 4/1969 | Feld | 106/447 |
| 3,702,733 | 11/1972 | Hall et al. | 355/77 |
| 3,925,096 | 12/1975 | Karkov | 427/221 |
| 4,522,686 | 6/1985 | Dumas | 162/158 |
| 4,687,519 | 8/1987 | Trzasko et al. | 106/208 |

FOREIGN PATENT DOCUMENTS

| | | | |
|---|---|---|---|
| 401477 | 2/1970 | Australia | 106/447 |
| 1-94937 | 4/1989 | Japan | 427/220 |
| 1118304 | 6/1968 | United Kingdom | 106/447 |

*Primary Examiner*—Shrive Beck
*Assistant Examiner*—Terry J. Owens
*Attorney, Agent, or Firm*—David J. Gould

[57] ABSTRACT

A process for coating at least one cationically charged ketene dimer on titanium dioxide comprising grinding the titanium dioxide in acidic aqueous media in the presence of a cationically charged ketene dimer.

12 Claims, No Drawings

PROCESS FOR COATING ALKYL KETENE DIMER ON TITANIUM DIOXIDE

BACKGROUND OF THE INVENTION

A problem which has long existed in the paper industry is that titanium dioxide used to enhance whiteness and opacity in paper is not readily retained by the cellulosic fibers of the paper. One solution to this problem is set forth in U.S. Pat. No. 2,992,964 which discloses coating alkyl ketene dimers on titanium dioxide. Such patent states that the coated titanium dioxide exhibits improved retention on the cellulosic fibers of the paper.

While this patent discloses an advance in the art, it would be desirable to have a process which would enhance sizing of the paper and increase the rate of size development. As used herein, "size" refers to the ability of a paper to resist adsorption of aqueous ink. A paper with good sizing will require a longer time for the ink to be adsorbed than a paper with poor sizing. Improved rate of size development (i.e., the final size developed by the paper) is also important because if the rate of size development is slow, this makes it difficult to adjust promptly the paper making conditions to optimize the desired amount of sizing.

It would also be desirable if the coated titanium dioxide would exhibit improved retention on the cellulosic fibers of the paper.

Moreover, it would be desirable if the coating of the titanium dioxide could take place during the formation of an aqueous dispersion of the titanium dioxide.

Reference is also made to the following patents which may be of interest to this invention:

U.S. Pat. No. 4,522,686 discloses aqueous dispersions of hydrophobic cellulose reactive sizing agents, such as ketene dimer, fortified with resin and a water-soluble, nitrogen-containing cationic dispersing agent.

U.S. Pat. No. 3,702,733 discloses preparing aqueous slurries of $TiO_2$. A portion of the $TiO_2$ is steam micronized in the presence of an alkanol amine.

SUMMARY OF THE INVENTION

In accordance with this invention there is provided:

Process for coating at least one cationically charged ketene dimer on titanium dioxide comprising grinding the titanium dioxide in acidic aqueous media in the presence of a cationically charged ketene dimer.

It has been found that the process of this invention can produce coated titanium dioxide which exhibits improved paper sizing and improved rate of formation of the size. It also has been found that the process of this invention produces a coated titanium dioxide having improved retention on the cellulosic fibers of the paper. Finally, the process of this invention is more efficient and less costly than prior art processes because the ketene dimer can be coated on the titanium dioxide while it is ground and dispersed into aqueous media.

DETAILED DESCRIPTION OF THE INVENTION

The following provides a more detailed description of the invention. The disclosures of all patents mentioned are hereby incorporated by reference.

Ketene Dimers

Ketene dimers suitable for use in this invention are cellulose-reactive paper sizing agents disclosed in U.S. Pat. No. 4,522,686. Generally, the ketene dimers will have the formula:

$$[R'''CH{=}C{=}O]_2$$

where R''' is a hydrocarbon radical, such as alkyl having at least 8 carbon atoms, cycloalkyl having at least 6 carbon atoms, aryl, aralkyl and alkaryl. In naming ketene dimers, the radical "R" is named followed by "ketene dimer". Thus, phenyl ketene dimer is:

$$-CH{=}C{=}O$$

benzyl ketene dimer is:

$$-CH_2{-}CH{=}C{=}O$$

and decyl ketene dimer is $[C_{10}H_{21}{-}CH{=}C{=}O]_2$.

Examples of ketene dimers include octyl, decyl, dodecyl, tetradecyl, hexadecyl, octadecyl, eicosyl, docosyl, tetracosyl, phenyl, benzyl, beta-napthyl, and cyclohexyl ketene dimers. Other examples include the ketene dimers prepared by known methods from montanic acid, naphthenic acid, delta$^{9,10}$-decylenic acid, delta$^{9,10}$-dodecylenic acid, palmitoleic acid, oleic acid, ricinoleic acid, linoleic acid, and eleosteric acid. Also, suitable ketene dimers can be prepared from naturally occurring mixtures of fatty acids, such as those mixtures found in coconut oil, babassu oil, palm kernel oil, palm oil, olive oil, peanut oil, rape oil, beef tallow, lard (leaf) and whale blubber. Mixtures of any of the above-named fatty acids with each other may also be used.

Preferred ketene dimers are those of an aliphatic ketene containing an aliphatic hydrocarbon group having from 6 to 12 carbon atoms.

Preferably, the ketene dimer will be cationically charged. Typically, the cationic charge is imparted by dispersing or mixing the ketene dimer in aqueous media in the presence of a cationic emulsifier. More specifically, the dispersion can be prepared by stirring the ketene dimer into an aqueous solution of an emulsifier and passing the premix through an homogenizer.

Emulsifiers conventionally employed in the production of emulsions of cellulose-reactive paper sizing agents are suitable. Such emulsifiers include cationic starches that are water-soluble starches containing sufficient amino groups, quaternary ammonium or other cationic groups to render the starch, as a whole, cellulose substantive. Examples of such cationic starches are the cationic amine-modified starches described in U.S. Pat. No. 3,130,113 and the known cationic starch graft copolymers. Other emulsifiers are the water-soluble cationic thermosetting resins obtained by reacting epichlorohydrin with a water-soluble aminopolyamide. The water-soluble aminopolyamine is formed from a 3 to 10 carbon dibasic carboxylic acid and a polyalkylene polyamine containing from 2 to 8 alkylene groups (see U.S. Pat. Nos. 2,926,116 and 2,926,154), with a water-soluble poly(dialkylamine) (see U.S. Pat. No. 3,966,654), with condensates of dicyandiamide or cyanamide and a polyalkylenepolyamine (see U.S. Pat. No. 3,403,113), with bis-aminopropylpiperazine or condensates thereof with dicyandiamide or cyanamide (see U.S. Pat. No. 4,243,481) and the like. Other suitable emulsifiers include polyacryamides, polyacrylates and polyethyleneimine. Generally, the emulsifier will be present in an amount of about 0.01–1%, based on the weight of the titanium dioxide.

Generally, the amount of ketene dimer used should be about 0.01–1.0%, preferably about 0.01–0.8%, and most preferably about 0.1–0.5%, based on the weight of the titanium dioxide.

Optionally, there can be used with the ketene dimer, fortified rosins, microcrystalline waxes, organic acid anhydrides, organic isocyanates or mixtures thereof. The compositions of these materials and appropriate amounts are specified in U.S. Pat. No. 4,522,686.

$TiO_2$ Grinding

Any method which is used to grind $TiO_2$ in aqueous media is suitable for use in this invention. By grind is meant to break up and disperse at least some of the aggregates and agglomerates of $TiO_2$. Such aggregates and agglomerates typically exist after production of the $TiO_2$.

Suitable grinding methods include disc milling such as by using a HOCKMEYER DISPERSER (manufactured by H. H. Hockmeyer, Inc.), as is disclosed in DeColibus U.S. Pat. No. 4,177,081; media milling as described in Jacobs et al. U.S. Pat. No. 3,313,492, and Whately U.S. Pat. No. 3,342,424; and high shear milling as is disclosed in Hall et al. U.S. Pat. No. 3,702,773, Gladu U.S. Pat. No. 4,288,254 and Slepteys U.S. Pat. No. 3,549,091, and Glaesar U.S. Pat. No. 4,214,913. Also suitable is the use of a vibrating media mill such as the VIBRO-ENERGY GRINDING MILL manufactured by Sweco Company.

During the grinding, the $TiO_2$ should preferably be present in aqueous media in an amount of about 40–85%, preferably about 50–80%, and most preferably about 70–80% by weight, based on the combined weight of the aqueous media and the $TiO_2$.

$TiO_2$

The $TiO_2$ used in the process of this invention can be produced by the chloride process or sulfate process. Preferably, the $TiO_2$ will be pigment grade. Especially preferred is $TiO_2$ produced by the chloride process, i.e., by the oxidation of $TiCl_4$. Most especially preferred is rutile $TiO_2$.

Process

The process of this invention entails bringing together the $TiO_2$, the cationically charged ketene dimer, and subjecting same to suitable grinding conditions in aqueous media. The grinding should take place for a time sufficient to coat the cationically charged ketene dimer on the $TiO_2$ and optionally to grind the pigment until the desired degree of deaggregation and deagglomeration is obtained. Suitable times are about 0.1–480 minutes, preferably about 0.5–180 minutes, and most preferably about 1–120 minutes. An especially preferred time is about 3–60 minutes.

Preferably, the aqueous media should be maintained at acidic conditions, so that flocculation of the ketene dimer is inhibited. Typically, the pH will be about 1.5–6.9, preferably about 2–6, and most preferably about 3–4. If raw $TiO_2$ produced from the oxidation of $TiCl_4$ is used, it often will have enough residual chlorides to produce a suitably acidic aqueous media when dispersed in water.

EXAMPLE 1

Raw $TiO_2$ produced by the chloride process was dispersed in water to make a 57.7% by weight solids slurry. The $TiO_2$ also contained minor amounts (less than 1.5%) of $P_2O_5$ and $Al_2O_3$. The $TiO_2$ slurry (17,210 lbs. $TiO_2$ at 57.5% solids) was screened through a 50 mesh screen and placed in a mixing tank with good agitation. One gallon of aminoethyl propanol was used to raise the pH to 3.8. To provide a concentration of 0.32 weight % (active ketene dimer on a solid $TiO_2$ basis), 920 pounds HERCON 40, Hercules Inc. product, cationic size emulsion (6.0% active alkyl ketene dimer ingredient) were slowly added to the mix tank.

This $TiO_2$ slurry was then fed into a Premier 125 liter HORIZONTAL MEDIA MILL changed to 85% capacity with $ZrO_2$:$SiO_2$ media ("Z beads", 1.0–1.6 mm bead size). The feed rate was adjusted to provide a 6.0 minute residence time in the grinding Media Mill. The long mill residence time was selected to help deagglomerate and deaggregate the $TiO_2$ slurry as well as to provide optimum "HERCON" 40/$TiO_2$ dispersion. As the cationic $TiO_2$ slurry exited the Media Mill, the slurry was screened through a 325 mesh vibrating Sweco screen to remove over-sized particles. The product of this process is herein referred to as Cationic Paper Slurry (CPS).

TABLE 1

Comparison of CPS Slurry Properties vs. Rutile Paper Slurry available from E. I. du Pont de Nemours and Company ("Du Pont Company") and designated as "RPS"

| Slurry Properties | CPS | RPS |
|---|---|---|
| % Solids | 56.6* | 71.5 |
| pH | 3.8 | 9.0 |
| Wt. % Grit** | 0.007 | 0.005 |

*Due to an error in the dilution, the $TiO_2$ wt. % solids was 56.6%, rather than 71.5%.

**Measured by weighing dry $TiO_2$ grit remained on a 325 mesh screen after lightly brushing the $TiO_2$ slurry with running water on the screen.

EXAMPLE 2

The $TiO_2$ slurry of Example 1 was tested in a Fourdrinier paper machine and compared to Du Pont's RPS.

The $TiO_2$ slurries were tested under alkaline paper making conditions, 7.5 pH, during production of 60 pound/Tappi ream, offset opaque paper (100% Western softwood, sulfite pulp). The order of addition of wet end chemicals to the Fourdrinier paper machine consisted of Continental Lime Inc., precipitated calcium carbonate (PCC) added to the blender chest; followed by alum at 1 lb./ton of pulp added to the tray water silo; followed by adding a 20% solids $TiO_2$ slurry added before the fan pump, followed by Hercules Inc. "HERCON" 70, alkyl ketene dimer size emulsion added after the fan pump; followed by Nalco Inc., NALCO 625 anionic, high molecular weight polyacrylamide retention aid at 0.25 lb./ton of pulp added between the primary screen and the headbox. Concentration of "HERCON" 70, PCC, CPS and RPS are specified in Table 2.

Table 2 shows that at an equal Tappi standard opacity of 93.3 for 60 pounds/ream offset opaque paper, the CPS overall first pass retention of fiber fines and ash fines had a delta of 10 percentage points higher than RPS. CPS had the same effect of improving first pass ash fines ($TiO_2$ and PCC) retention in the paper as compared to RPS. Table 2 also shows that CPS required less addition of "Hercon" 70 sizing and had higher sizing values as measured by the Hercules Size Test (HST) equipment. Size development (HST) was observed to be qualitatively faster and did not require heat aging in the paper in order to develop full sizing when using CPS versus RPS. CPS required less percent $TiO_2$ in the paper sheet to achieve the same opacity (thus, improved $TiO_2$ retention) and had a higher optical scattering efficiency, $TiO_2$ S.

TABLE 2

Comparison of CPS vs. RPS While Producing 60 Pound/Ream Offset Opaque Paper

| | CPS | RPS |
|---|---|---|
| First Pass Retention % | 90 | 80 |
| First Pass Ash Retention % | 80 | 70 |
| "HERCON" 70 size addition rate (lb. product/ton of paper)/paper HST (seconds) | 1.7/1000 | 2.8/800 |
| $TiO_2$ Scattering Co-efficient - $TiO_2$ S (ream/lb). | 0.57 | 0.55 |
| % Precipitated Calcium Carbonate in the Sheet | 12 | 12 |
| % $TiO_2$ in the Sheet | 3.7 | 5.5 |

The invention claimed is:

1. Process for coating at least one cationically charged ketene dimer on titanium dioxide comprising grinding the titanium dioxide in acidic aqueous media in the presence of a cationically charged ketene dimer.

2. The process of claim 1 wherein the titanium dioxide is raw titanium dioxide produced by the oxidation of titanium tetrachloride.

3. The process of claim 1 wherein the n grinding is media milling or high shear grinding.

4. The process of claim 1 wherein the cationically charged ketene dimer is present in an amount of about 0.01–1.0 percent, based on the weight of the titanium dioxide.

5. The process of claim 1 wherein the cationically charged ketene dimer is present in an amount of about 0.01–0.5 percent, based on the weight of the titanium dioxide.

6. The process of claim 1 wherein the cationic charge on the ketene dimer is imparted by dispersing or mixing the ketene dimer in the aqueous media in the presence of a cationic emulsifier selected from the group consisting of cationic starches, water-soluble cationic thermosetting resins obtained by reacting epichlorohydrin with a water-soluble aminopolyamine, polyacrylates, and polyethyleneimine.

7. The process of claim 1 wherein the titanium dioxide is raw titanium dioxide produced by the oxidation of titanium tetrachloride, and the grinding is media milling or high shear grinding.

8. The process of claim 7 wherein the cationically charged ketene dimer is present in an amount of about 0.01–1.0 percent, based on the weight of the titanium dioxide.

9. The process of claim 1 wherein in the acidic aqueous media there is also present a fortified rosin, microcrystalline wax, organic acid anhydride, organic isocyanate or mixtures thereof.

10. The process of any one of claims 1–9 wherein the pH of the acidic aqueous media is about 1.5–6.9.

11. The process of any one of claims 1–9 wherein the $TiO_2$ is present in an amount of about 40–85 percent based on the combined weight of the titanium dioxide and the aqueous media.

12. The process of claim 1 wherein (a) the titanium dioxide is raw titanium dioxide produced by the oxidation of titanium tetrachloride, (b) the cationically charged ketene dimer is present in an amount of about 0.01–1.0 percent, based on the weight of the titanium dioxide, (c) the ketene dimer is an alkyl ketene dimer wherein the alkyl group has about 1–12 carbon atoms, (d) the titanium dioxide is present in an amount of about 40–85% by weight, based on the combined weight of the titanium dioxide and the aqueous media, and (e) the pH of the acidic aqueous media is about 1.5–6.9.

* * * * *